US006809712B2

(12) United States Patent
Takeda

(10) Patent No.: US 6,809,712 B2
(45) Date of Patent: Oct. 26, 2004

(54) DRIVE CIRCUIT OF LIQUID CRYSTAL DISPLAY, HAVING CLIP CIRCUIT BEFORE POLARITY INVERSION CIRCUIT

(75) Inventor: Hiroshi Takeda, Tokyo (JP)

(73) Assignee: NEC LCD Technologies, Ltd., Kanagawa (JP)

( * ) Notice: Subject to any disclaimer, the term of this patent is extended or adjusted under 35 U.S.C. 154(b) by 68 days.

(21) Appl. No.: 09/802,215

(22) Filed: Mar. 8, 2001

(65) Prior Publication Data

US 2001/0024182 A1 Sep. 27, 2001

(30) Foreign Application Priority Data

Mar. 14, 2000 (JP) ..... P2000-071179

(51) Int. Cl.[7] ..... G09G 5/00

(52) U.S. Cl. ..... 345/87; 345/84; 345/204; 345/208; 345/210; 345/212; 345/214; 348/679; 348/690; 349/143

(58) Field of Search ..... 345/84, 87, 104, 345/208, 210, 212, 214; 348/679, 690; 349/143

(56) References Cited

U.S. PATENT DOCUMENTS 3,898,532 A * 8/1975 Frank ..... 361/88
5,021,886 A * 6/1991 Shibayama ..... 348/690
5,640,212 A * 6/1997 Baccarini ..... 348/671
6,023,305 A * 2/2000 Ando et al. ..... 348/679
6,094,192 A * 7/2000 Kobayashi et al. ..... 345/210
6,144,354 A * 11/2000 Koyama et al. ..... 345/98
6,504,585 B2 * 1/2003 Ohkawara et al. ..... 349/38

FOREIGN PATENT DOCUMENTS

| | | |
|---|---|---|
| JP | H4-238476 | 8/1992 |
| JP | H5-292431 | 11/1993 |
| JP | 6-161386 | 6/1994 |
| JP | H7-20815 | 1/1995 |
| JP | 7-222077 | 8/1995 |
| JP | H7-222083 | 8/1995 |
| JP | H9-90909 | 4/1997 |
| JP | 9-331542 | 12/1997 |
| JP | 11-38942 | 2/1999 |

* cited by examiner

*Primary Examiner*—Bipin Shalwala
*Assistant Examiner*—Vincent E. Kovalick
(74) *Attorney, Agent, or Firm*—Scully, Scott, Murphy & Presser

(57) ABSTRACT

A drive circuit of an LCD is disclosed, by which no image signal having a voltage level over the dynamic range of the video amplifier, and thus erroneous operation of the video amplifier is prevented, thereby supplying normal image signals to the LCD. The drive circuit comprises a clip circuit for clipping the amplitude range of the voltage of a picture signal input from an input terminal; a polarity inversion circuit for receiving the picture signal whose amplitude range was clipped by the clip circuit, and for converting the picture signal so that an inverted signal and a non-inverted signal are alternately assigned to each dot; and a video amplifier for amplifying the voltage level of the converted picture signal by a predetermined amplification degree.

7 Claims, 6 Drawing Sheets

DRIVE CIRCUIT OF LIQUID CRYSTAL DISPLAY, HAVING CLIP CIRCUIT BEFORE POLARITY INVERSION CIRCUIT

BACKGROUND OF THE INVENTION

1. Field of the Invention

The present invention relates to a drive circuit of an active-matrix type liquid crystal display (LCD), which supplies a picture signal to the LCD so as to drive the liquid crystal elements.

2. Description of the Related Art

Generally, displays are the most important electronic devices for interconnecting machines and humans. That is, displays communicate various visual data to humans via characters and images. In particular, after personal computers appeared, displays became indispensable electric devices and have been improved so as to realize more convenient display forms for humans.

Recently, LCDs are widely used as displays for notebook-sized personal computers or portable information devices. This is because LCDs are thinner and lighter than CRT (cathode-ray tube) displays. Therefore, in personal computers, it is important to satisfactorily display multimedia data (in particular, image data) obtained via the Internet or the like; therefore, the quality of images shown on LCDs is important.

In addition, LCDs are also widely used as displays of liquid crystal televisions or used as viewfinders of video cameras; therefore, liquid crystal elements must be driven for sufficiently representing the gradation data of each picture signal.

FIG. 8 shows a conventional drive circuit of an active-matrix type LCD. In the figure, in order to improve the quality of the images as explained above, gamma correction circuit 1 is provided for correcting the linearity of the gradations (of gradation data of each input picture signal) with respect to the quantity of light. In addition, in order to improve the quality of the images displayed on LCD 4, the drive circuit employs means for improving the S/N ratio of each of gamma correction circuit 1, polarity inversion circuit 33, and video amplifier 34, and for increasing the dynamic range of the video amplifier 34.

However, in the above-explained drive circuit of a conventional LCD, an image signal having a voltage level over each dynamic range of the gamma correction circuit 1, polarity inversion circuit 33, and video amplifier 34 may be input into those circuits. If an image signal having a voltage level over the dynamic range of the video amplifier 34 is input, then the video amplifier 34 does not normally operate and does not output normal picture signals, and a ghost or the like appears on the display screen of the LCD, thereby degrading the quality of the displayed image. On the other hand, if an image signal having a voltage level over the dynamic range of the polarity inversion circuit 33 is input, then the following video amplifier 34 does not output normal picture signals, and a ghost or the like appears on the display screen of the LCD, thereby degrading the quality of the displayed image.

SUMMARY OF THE INVENTION

In consideration of the above circumstances, an objective of the present invention is to provide a drive circuit of an LCD, by which no image signal having a voltage level over the dynamic range of each circuit element is input, and thus erroneous operation of each circuit element is prevented, thereby supplying normal image signals to the LCD.

Therefore, the present invention provides a drive circuit of an active-matrix type liquid crystal display (LCD), for supplying a picture signal, whose polarity is alternately changed like an alternating current, to each electrode of liquid crystal elements of the LCD, comprising:

- a clip circuit for clipping the amplitude range of the voltage of the picture signal input from an input terminal;
- a polarity inversion circuit for receiving the picture signal whose amplitude range was clipped by the clip circuit, and for converting the picture signal so that an inverted signal and a non-inverted signal are alternately assigned to each dot; and
- a video amplifier for amplifying the voltage level of the converted picture signal by a predetermined amplification degree.

Typically, the drive circuit clips the amplitude range of the voltage of the picture signal in a manner such that the clipped amplitude range is suitable for the dynamic range of the video amplifier and the output voltage level from the video amplifier does not exceed the relevant dynamic range.

Preferably, the upper limit voltage and the lower limit voltage of the amplitude range in the clipping operation executed by the clip circuit are variable according to the voltage of a control signal supplied to the clip circuit.

The clip circuit may comprise two serially connected transistors, and predetermined control voltages are respectively applied to the bases of the two transistors, and the contact between the two transistors may be connected to an input terminal of the polarity inversion circuit.

In this case, the upper limit voltage and the lower limit voltage of the amplitude range in the clipping operation executed by the clip circuit are variable according to the control voltages.

The clip circuit may comprise two serially connected diodes, and predetermined control voltages are respectively applied to the cathode of one of the two diodes and the anode of the other diode, and the contact between the two diodes is connected to an input terminal of the polarity inversion circuit.

In this case, the upper limit voltage and the lower limit voltage of the amplitude range in the clipping operation executed by the clip circuit are variable according to the control voltages.

The drive circuit may further comprise:

- a gamma correction circuit for correcting the gradation characteristics of the picture signal, and wherein:
- the clip circuit is connected to an input terminal of the gamma correction circuit and an output terminal of the gamma correction circuit is connected to an input terminal of the polarity inversion circuit.

Preferably, the drive circuit clips the amplitude range of the voltage of the picture signal in a manner such that the clipped amplitude range is suitable for the dynamic range of the gamma correction circuit and the output voltage level from the gamma correction circuit does not exceed the relevant dynamic range.

Also preferably, the drive circuit clips the amplitude range of the voltage of the picture signal in a manner such that the clipped amplitude range is suitable for the dynamic range of the polarity inversion circuit and the output voltage level from the polarity inversion circuit does not exceed the relevant dynamic range.

According to the present invention, the clip circuit can clip the amplitude range of the input picture signal corresponding to the dynamic range of the video amplifier; thus, it is possible to prevent a picture signal having a voltage level which exceeds the dynamic range of the video amplifier from inputting. Therefore, an erroneous operation of the video amplifier can be prevented, and normal picture signals can be continuously output from the video amplifier, thereby improving the quality of images displayed on the screen of the LCD.

In addition, the clip circuit can also clip the amplitude range of the input picture signal corresponding to the dynamic range(s) of the video amplifier and the polarity inversion circuit and/or the gamma correction circuit. Therefore, also in the polarity inversion circuit, it is possible to prevent a picture signal having a voltage level which exceeds the dynamic range of the polarity inversion circuit from inputting. Therefore, normal picture signals can be continuously output from the polarity inversion circuit, and no undesirable effect is imposed on the following video amplifier. Accordingly, normal picture signals can be continuously output from the video amplifier, thereby improving the quality of images displayed on the screen of the LCD.

DESCRIPTION OF THE PREFERRED EMBODIMENTS

Hereinafter, embodiments according to the present invention will be explained in detail with reference to the drawings.

Figure 1:
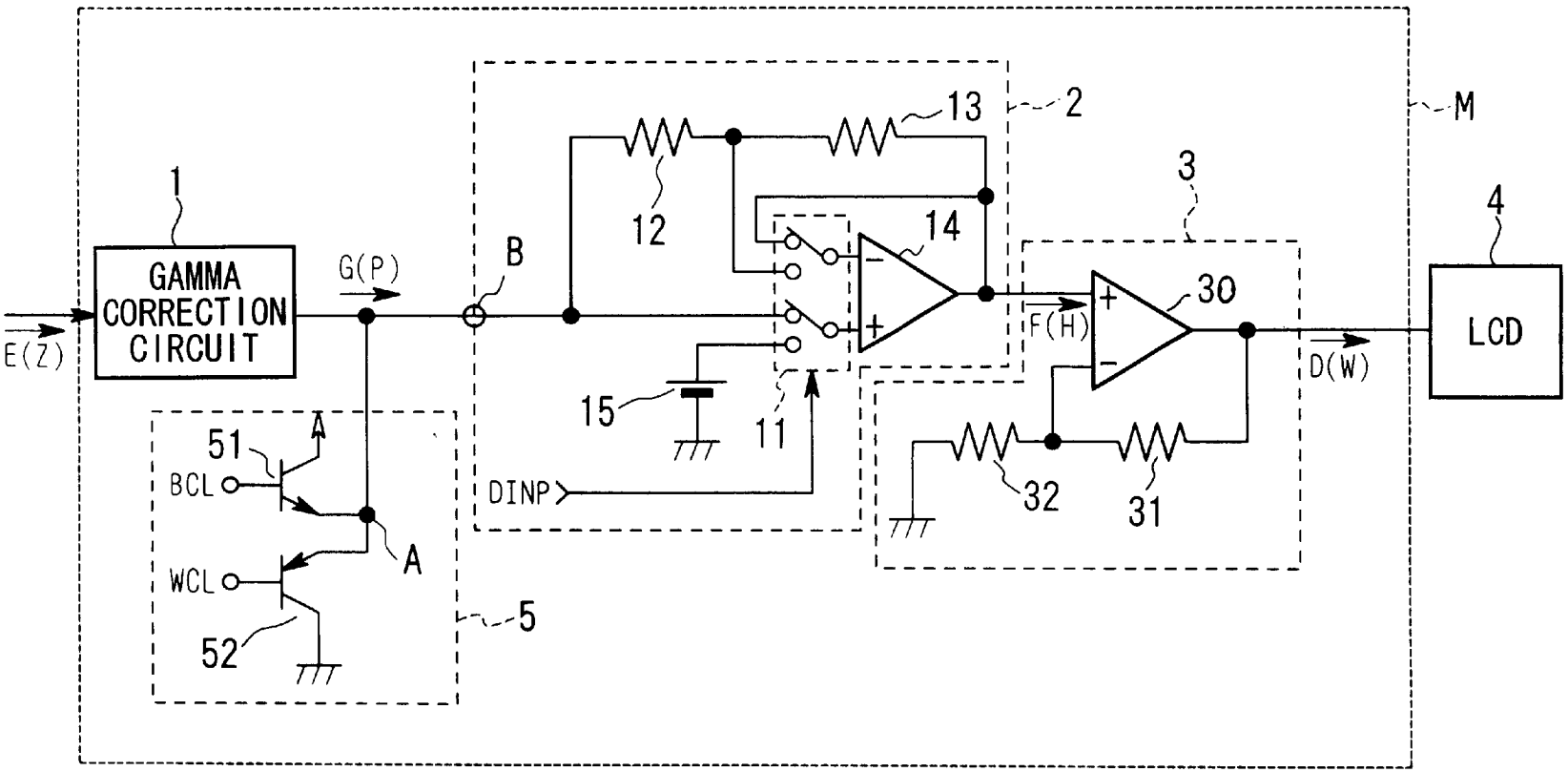
FIG. 1 is a block diagram showing the structure of the drive circuit M of an LCD, as an embodiment according to the present invention.
Figure 8:
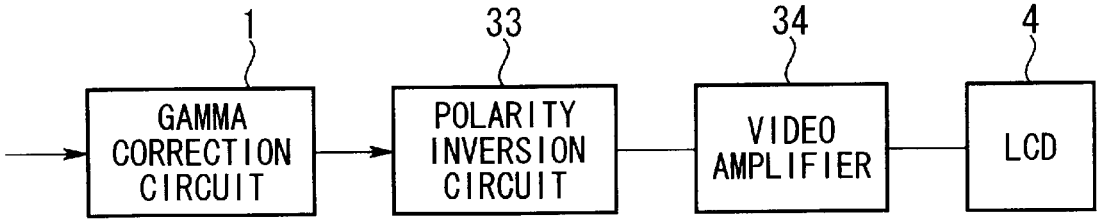
FIG. 8 is a block diagram showing the structure of a conventional drive circuit of an LCD.

FIG. 1 is a block diagram showing the structure of a drive circuit M of an LCD (hereinbelow, it may be simply called "drive circuit M"), as an embodiment (the first embodiment) according to the present invention. In FIG. 1, parts which are identical to those in FIG. 8 are given the identical reference numerals, and explanations thereof are omitted.

In order to solve the above-explained problems in the conventional LCDs, a clip circuit for clipping the amplitude of picture signal F may be provided immediately before the video amplifier 3, so that the clipped range is within the dynamic range of the video amplifier 3 (see, for example, Japanese Unexamined Patent Application, First Publication, No. Hei 11-38942). However, in such an arrangement, when the clipping operation is executed, a DC (direct current) voltage is continuously applied to the liquid crystal elements of the LCD according to an error between the inverted signal and the non-inverted signal of the picture signal F which was processed in the polarity inversion circuit 2, for example, to a difference between the absolute values of the "black" level of the inverted signal and the "black" level of the non-inverted signal.

In addition, if the level of the picture signal G output from the gamma correction circuit 1 exceeds the dynamic range of the polarity inversion circuit 2, the circuit 2 does not output a normal picture signal F, and thus the video amplifier 3 cannot output a normal picture signal F.

Therefore, in the present embodiment, a clip circuit 5 is provided immediately before the polarity inversion circuit 2.

In FIG. 1, the output terminal of gamma correction circuit 1 is connected to input terminal B of the polarity inversion circuit 2, and the gamma correction circuit 1 corrects disorder (caused by an input/output device) in the gradation characteristics of the picture signal E (i.e., gamma correction), and outputs a corrected picture signal G. In particular, correct gradation of the picture signal E is reproduced so as to correctly indicate the range of the quantity of light of the picture signal F.

The clip circuit 5 consists of a serially connected NPN-type bipolar transistor 51 and PNP-type bipolar transistor 52. The contact A between the emitter of the bipolar transistor 51 and the emitter of the bipolar transistor 52 is connected to the input terminal B of the polarity inversion circuit 2.

The clip circuit 5 controls the amplitude range of the picture signal G, that is, suitably limits the voltage of each of the white level and the black level of the picture signal G, so as to satisfy the dynamic ranges of the following polarity inversion circuit 2 and video amplifier 3. In the clip circuit 5, an output control signal BCL having a defined control voltage $V_{BCL}$ is input into the base of the bipolar transistor 51, and an output control signal WCL having a defined control voltage $V_{WCL}$ is input into the base of the bipolar transistor 52. The control voltage $V_{BCL}$ and the control voltage $V_{WCL}$ have fixed voltage values by which the dynamic ranges of the following circuit elements are satisfied.

Figure 2:
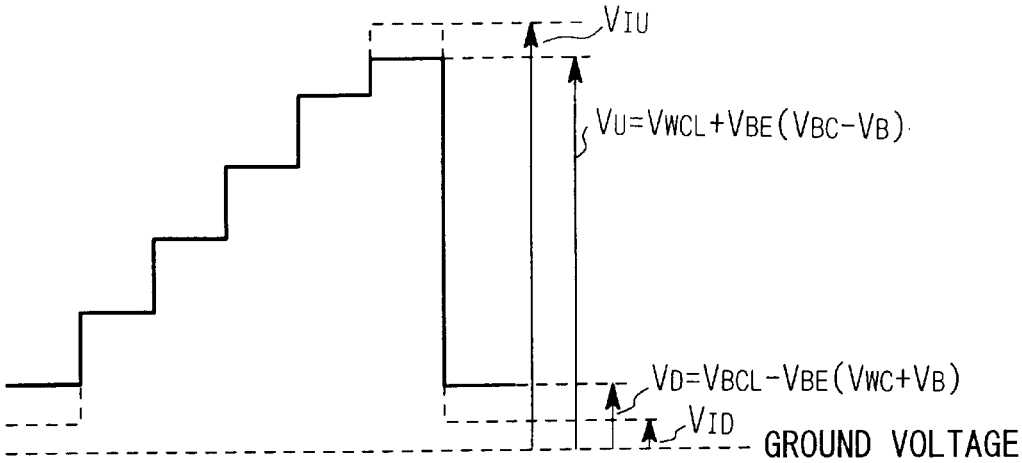
FIG. 2 is a diagram for explaining the concept of the clipping operation of the amplitude range of the voltage of picture signal G which is output from the gamma correction circuit 1.

Here, it is assumed that in both the bipolar transistors 51 and 52, the voltage between the base and emitter is $V_{BE}$. The voltage range obtained by the above clipping operation is then between the upper limit voltage $V_U$ (control voltage $V_{WCL}$+voltage $V_{BE}$) and the lower limit voltage $V_D$ (control voltage $V_{BCL}$−voltage $V_{BE}$). Here, FIG. 2 is a diagram for explaining the concept of the clipping operation of the amplitude range of the voltage of picture signal G which is output from the gamma correction circuit 1.

Accordingly, if the maximum voltage $V_{IU}$ of the picture signal G output from the gamma correction circuit 1 exceeds the upper limit voltage $V_U$, the bipolar transistor 52 is switched on, and the voltage level of the picture signal G is decreased to the level of "control voltage $V_{WCL}$+voltage $V_{BE}$", so that the voltage range of the picture signal G is clipped to have the upper voltage level of "control voltage $V_{WCL}$+voltage $V_{BE}$".

On the other hand, if the minimum voltage $V_{ID}$ does not reach the lower limit voltage $V_D$, the bipolar transistor 51 is switched on, and the voltage level of the picture signal G is increased to the level of "control voltage $V_{BCL}$–voltage $V_{BE}$", so that the voltage range of the picture signal G is clipped to have the lower level of "control voltage $V_{BCL}$–voltage $V_{BE}$".

Here, the control voltage $V_{WCL}$ or the control voltage $V_{BCL}$ may be changed according to the amplitude range of the input picture signal G, by using a control voltage circuit (not shown). The reasons for providing this function (of changing the control voltage) are: (i) the characteristics of the clipping circuit are not fixed for each LCD, and such dispersion in the characteristics should be absorbed, and (ii) each device has a specific clipping point (i.e., clipping voltage), that is, the kinds of devices used as the polarity inversion circuit and the video amplifier are not fixed for each product.

The polarity inversion circuit 2 comprises a switching circuit 11 for controlling the inversion of polarity, a differential amplifier 14, an inversion reference power supply 15 (voltage $V_{DAREF}$), and resistors 12 and 13. The resistances of the resistors 12 and 13 are the same. The differential amplifier 14 executes the inverting or non-inverting operation of the input picture signal G with respect to the center voltage $V_{DAREF}$.

Therefore, the polarity inversion circuit 2 receives the picture signal output from the gamma correction circuit 1 (that is, the gamma-corrected picture signal) and outputs the picture signal having the original polarity or having the inverted polarity. In the polarity inversion circuit 2, whether the polarity of the picture signal is inverted or not inverted is selected based on the signal level of a polarity inversion signal DINP, by using the switching circuit 11.

For example, if the signal level of the polarity inversion signal DINP is low ("L"), the input picture signal is output as the non-inverted picture signal from the polarity inversion circuit 2, while if the signal level of the polarity inversion signal DINP is high ("H"), the input picture signal is output as the inverted picture signal from the polarity inversion circuit 2.

Figure 3:
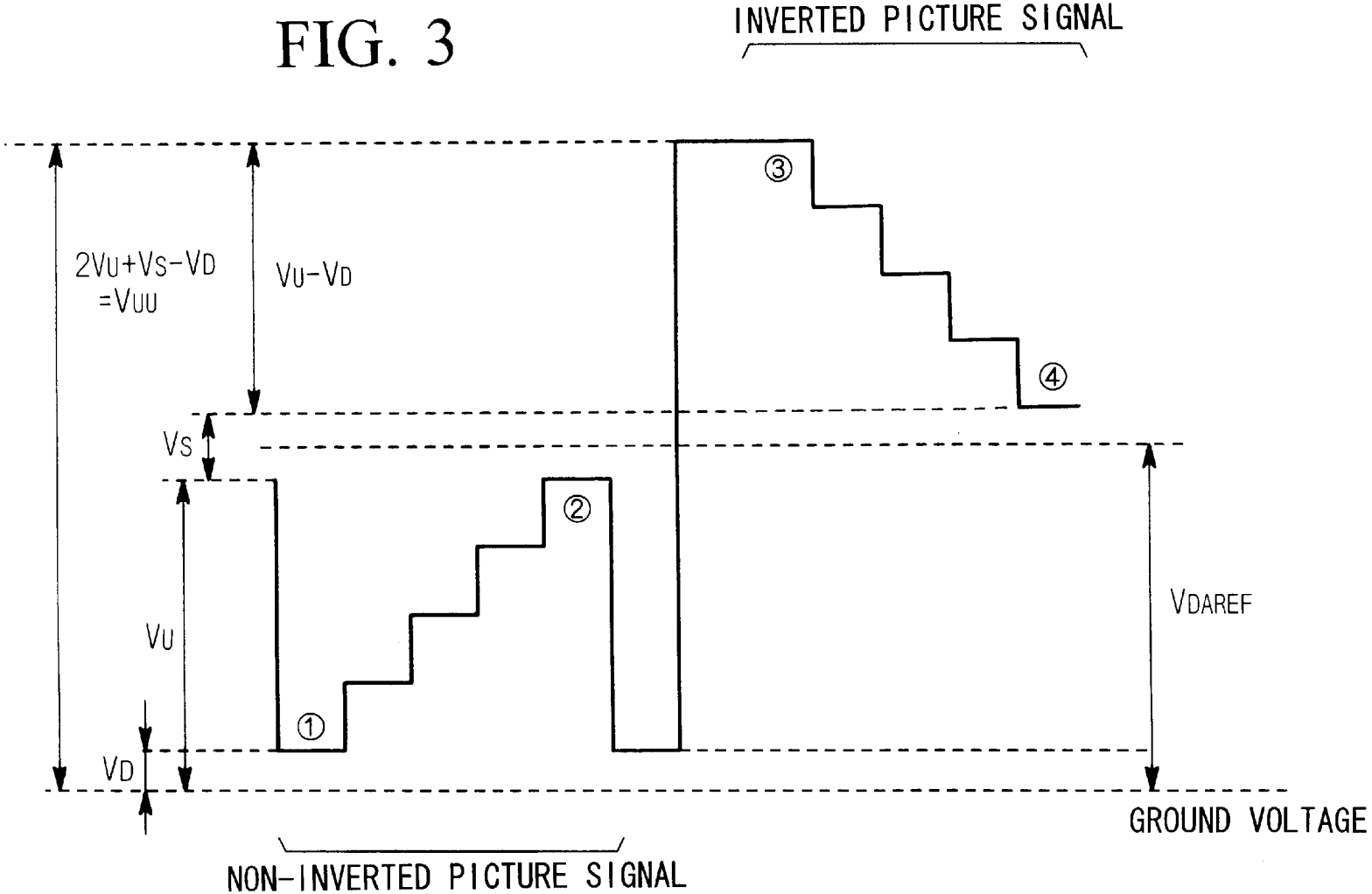
FIG. 3 shows the range of the voltage level of the picture signal F, whose polarity has been inverted in the polarity inversion circuit 2 in FIG. 1.

FIG. 3 shows the range of the voltage level of the picture signal F, whose polarity has been inverted in the polarity inversion circuit 2. In the picture signal F, level ① indicates the black level of the non-inverted signal, while level ② indicates the white level of the non-inverted signal. Also in the picture signal F, level ③ indicates the black level of the inverted signal, while level ④ indicates the white level of the inverted signal. The function of the polarity inversion circuit 2 will be explained below with reference to FIG. 3 which shows the voltage level of picture signal F.

In the voltage level of the picture signal F, the lower limit value is the lower limit voltage $V_D$, while the upper limit value is obtained by "upper limit voltage $V_U$+voltage $V_S$+(upper limit voltage $V_U$–lower limit voltage $V_D$)", that is, the upper limit value $V_{UU}$ is "$2V_U+V_S-V_D$".

The voltage $V_{DAREF}$ of the inversion reference power supply 15 has the center value between the upper limit value $V_{UU}$ and the lower limit voltage $V_D$. That is, the voltage $V_{DAREF}$ is defined to satisfy the condition that the value "the upper limit value $V_{UU}$–voltage $V_{DAREF}$" is equal to the value "the voltage $V_{DAREF}$–lower limit voltage $V_D$".

In each scanning line of the display screen of the LCD, it is necessary to alternately invert the polarity of the voltage applied to each dot, that is, in any gradation level, a signal having a shape like an alternating current signal should be applied to the liquid crystal elements corresponding to the relevant dots. The above voltage $V_S$ indicates a voltage difference necessary for driving the liquid crystal elements corresponding to each dot at either of the white level ② of the non-inverted picture signal or the white level ④ of the inverted picture signal.

The video amplifier 3 has resistors 31 and 32, and differential amplifier 30 for amplifying the voltage level of the input picture signal F, where the amplification degree is $\alpha$.

If it is assumed that the upper limit value and the lower limit value of the dynamic range of the video amplifier 3 are respectively $V_{ZU}$ and $V_{ZD}$, then the voltage level of the picture signal F must satisfy the following formulas:

$$V_{ZU} \geqq \alpha \times V_{UU} = \alpha \times (2V_U + V_S - V_D) \quad (1)$$

$$V_{ZD} \leqq \alpha \times V_D \quad (2)$$

In order to satisfy the above formulas (1) and (2), the amplitude of the picture signal G output from the gamma correction circuit 1 should be in a range from the lower limit voltage $V_D$ and the upper limit voltage $V_U$. Accordingly, in the clip circuit 5, the control voltage $V_{WCL}$ of the output control signal WCL and the control voltage $V_{BCL}$ of the output control signal BCL are defined.

As explained above, according to the drive circuit M of the LCD of the present invention, the clip circuit 5 clips the amplitude of the input picture signal G to have an amplitude range corresponding to the dynamic range of the video amplifier 3. Therefore, it is possible to prevent a picture signal having a voltage level which exceeds the dynamic range of the video amplifier 3 from inputting, and to prevent an erroneous operation of the video amplifier 3. Accordingly, a normal picture signals is continuously output from the video amplifier 3, and the quality of the image shown on the display screen of the LCD is improved.

Also, according to the drive circuit M of the LCD of the present invention, the clip circuit 5 clips the amplitude of the input picture signal G to have an amplitude range corresponding to the dynamic range of the video amplifier 3, as explained above. Therefore, also in the polarity inversion circuit 2, it is possible to prevent a picture signal having a voltage level which exceeds the dynamic range of the polarity inversion circuit 2 from inputting. Accordingly, as explained above, a normal picture signal is continuously output from the video amplifier 3, and the quality of the image shown on the display screen of the LCD is improved.

Figure 4:
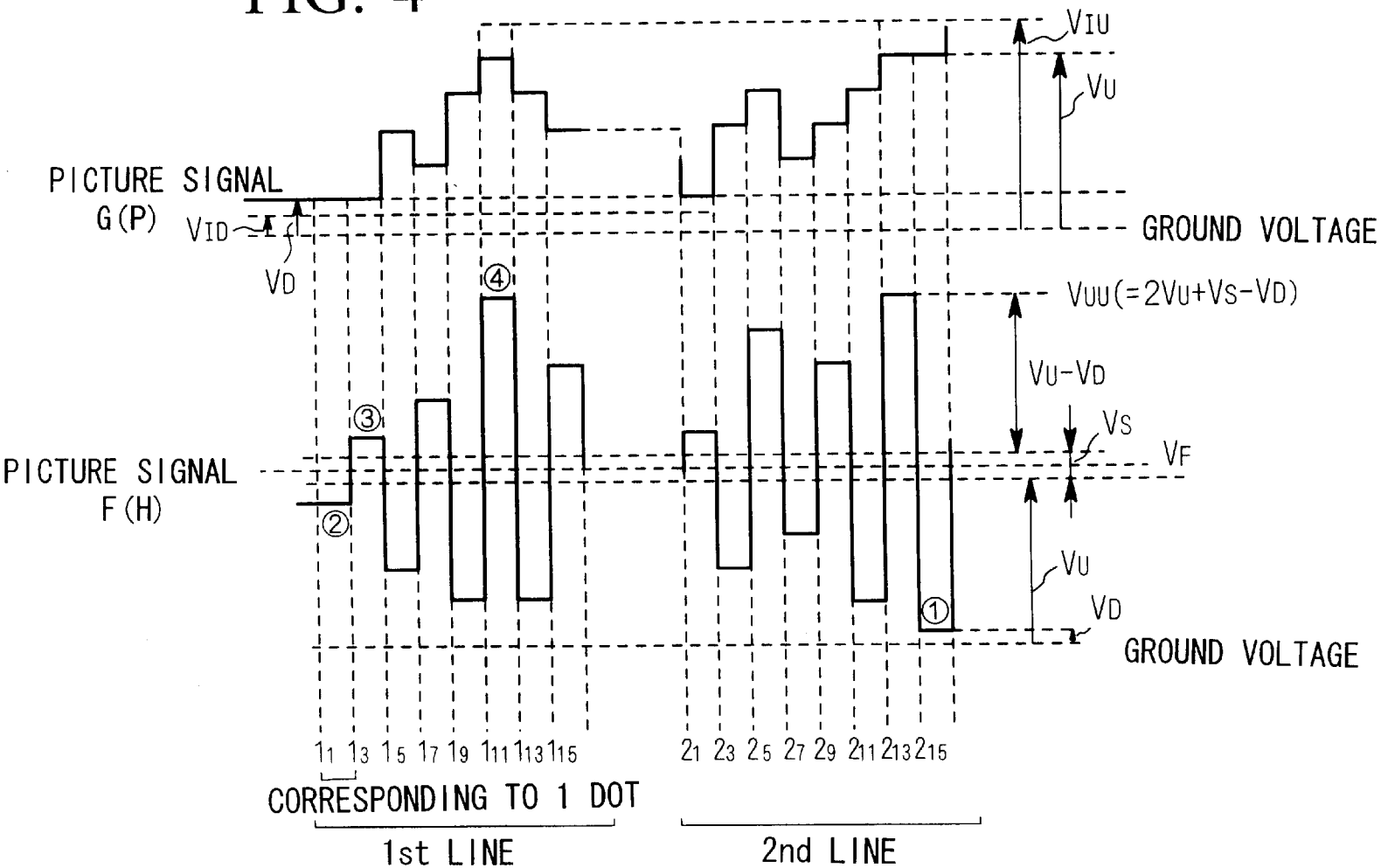
FIG. 4 shows the relationship between the output voltage level of the picture signal G whose amplitude range was clipped by the clip circuit 5, and the output voltage level of the picture signal F for which the polarity inverting operation was performed by the polarity inversion circuit 2, in the operation of the drive circuit M.

Below, with reference to FIGS. 1, 2, and 4, an operation example of the present embodiment will be explained. FIG. 4 shows the relationship between the output voltage level of the picture signal G whose amplitude range was clipped by the clip circuit 5, and the output voltage level of the picture signal F for which the polarity inverting operation was performed by the polarity inversion circuit 2.

In the explanation of the operation example, it is assumed that two drive circuits similar to the drive circuit M of the LCD as shown in FIG. 1 are respectively provided for both (i) the dots having even numbers (e.g., dot "12" which denotes the 12th dot) in each (scanning) line and (ii) the dots having odd numbers (e.g., dot "1" which denotes the first dot, refer to FIG. 4) in each line. Each drive circuit outputs a drive signal corresponding to the relevant dot.

That is, below, the first drive circuit M of the LCD corresponding to the odd-number dots and the second drive circuit M of the LCD corresponding to the even-number dots, both drive circuits having the same structure as that shown in FIG. 1, are used in the following explanation, in which the signal names are suitably arranged. Here, the name of the picture signal corresponding to the odd-number dots and the name of the picture signal corresponding to the even-number dots are different so as to indicate that different drive circuits M of the LCD are respectively provided for the odd-number dots and the even-number dots. In FIG. 1, each character in the brackets indicates a signal name corresponding to the even-number dots.

First, the frequency-dividing operation of a picture signal input from an external device is performed, and a picture signal E corresponding to the odd-number dots ("$1_1$", "$1_3$", "$1_5$", "$1_7$", "$1_9$", "$1_{11}$", "$1_{13}$", "$1_{15}$", . . . (each indicates a dot having an odd number)) and a picture signal Z corresponding to the even-number dots ("$1_2$", "$1_4$", "$1_6$", "$1_8$", "$1_{10}$", "$1_{12}$", "$1_{14}$", "$1_{16}$", . . . (each indicates a dot having an even number)) are generated.

Here, it is assumed that the picture signal E corresponding to the odd-number dots ("$1_1$", "$1_3$", "$1_5$", "$1_7$", "$1_9$", "$1_{11}$", "$1_{13}$", "$1_{15}$", . . . ) is input into the first drive circuit M of the LCD as shown in FIG. 1. Similarly, it is assumed that the picture signal Z corresponding to the even-number dots ("$1_2$", "$1_4$", "$1_6$", "$1_8$", "$1_{10}$", "$1_{12}$", "$1_{14}$", "$1_{16}$", . . . ) is input into the second drive circuit M of the LCD as shown in FIG. 1.

The gamma correction circuit 1 of the first drive circuit M executes the gamma correction of the input picture signal E, and outputs a picture signal G to the polarity inversion circuit 2. Similarly, the gamma correction circuit 1 of the second drive circuit M executes the gamma correction of the input picture signal Z, and outputs a picture signal P to the polarity inversion circuit 2.

The picture signal G output from the gamma correction circuit 1 after the gamma correction has an amplitude within a range between the maximum voltage $V_{IU}$ and the minimum voltage $V_{ID}$. If the maximum voltage $V_{IU}$ exceeds the upper limit voltage $V_U$ and if the minimum voltage $V_{ID}$ does not reach the lower limit voltage $V_D$ (here, the values $V_U$ and $V_D$ satisfy the above formulas (1) and (2)), then the maximum voltage $V_{IU}$ is clipped to the upper limit voltage $V_U$, while the minimum voltage $V_{ID}$ is increased to have the lower limit voltage $V_D$ (for example, see the picture signal G in FIG. 4).

Similarly, in the drive circuit 5 of the second drive circuit M, the amplitude range of the picture signal P is also clipped between the upper limit voltage $V_U$ and the lower limit voltage $V_D$.

Next, for each scanning line on the display screen of the LCD, the picture signal G is processed by the polarity inversion circuit 2, and a picture signal F is output from the polarity inversion circuit 2. More specifically, the picture signal G ("$1_1$", "$1_3$", "$1_5$", "$1_7$", "$1_9$", "$1_{11}$", "$1_{13}$", "$1_{15}$", . . . ) which is time-series input for each dot of the first scanning line is output from the polarity inversion circuit 2 as picture signal F ("$1_1$", "$1_3$", "$1_5$", "$1_7$", "$1_9$", "$1_{11}$", "$1_{13}$", "$1_{15}$", . . . ). Here, each "1" indicates the first line, and each subscript indicates a dot number. Similarly, the picture signal G ("$2_1$", "$2_3$", "$2_5$", "$2_7$", "$2_9$", "$2_{11}$", "$2_{13}$", "$2_{15}$", . . . ) which is time-series input for each dot of the second scanning line is output from the polarity inversion circuit 2 as picture signal F ("$2_1$", "$2_3$", "$2_5$", "$2_7$", "$2_9$", "$2_{11}$", "$2_{13}$", "$2_{15}$", . . . ). Here, each "2" indicates the second line, and each subscript indicates a dot number.

The LCD to which the present invention is applied employs a dot-inversion method. Therefore, in the above process, in the polarity inversion circuit 2 of the drive circuit M, a polarity inversion signal DINP is supplied to the switching circuit 11 in a manner such that the low (L) level and the high (H) level of the signal is changed according to the scanning timing of the time-series-input picture signal corresponding to each dot. Accordingly, a drive signal having a shape similar to an alternating current signal is supplied for each dot.

Here, any adjacent dots both in the cross direction and the longitudinal direction (perpendicular to the cross direction) must have different polarities, that is, the inverted polarity and the non-inverted polarity. Therefore, a polarity control circuit (not shown) controls the polarity inversion signal DINP in a manner such that the level of the signal DINP supplied to the first drive circuit M corresponding to the odd-number dots and the level of the signal DINP supplied to the second drive circuit M corresponding to the even-number dots have opposite characteristics to each other.

For example, in the scanning of line 1, the above polarity control circuit supplies a polarity inversion signal DINP having the "L" level to the polarity inversion circuit 2 of the first drive circuit M, while the above polarity control circuit supplies a polarity inversion signal DINP having the "H" level to the polarity inversion circuit 2 of the second drive circuit M. Accordingly, a non-inverted signal is provided to dot "$_1$", dot "$1_3$", . . . , dot "$1_{15}$" relating to the picture signal F, while an inverted signal is provided to dot "$1_2$", dot "$1_4$", . . . , dot "$1_{16}$" relating to the picture signal H.

In the scanning of the second line, the polarity control circuit supplies a polarity inversion signal DINP having the "H" level to the polarity inversion circuit 2 of the first drive circuit M, while the above polarity control circuit supplies a polarity inversion signal DINP having the "L" level to the polarity inversion circuit 2 of the second drive circuit M. Accordingly, an inverted signal is provided to dot "$2_1$", dot "$2_3$", . . . , dot "$2_{15}$"relating to the picture signal F, while a non-inverted signal is provided to dot "$2_2$", dot "$2_4$", . . . , dot "$2_{16}$" relating to the picture signal H.

Also for each of the following lines, an operation similar to that suitable for the line 1 or line 2 is performed. More specifically, an operation similar to that applied to the line 1 is performed to odd-number lines 3, 5, . . . , while an operation similar to that applied to the line 2 is performed to even-number lines 4, 6, . . . .

For example, in FIG. 4, a non-inverted picture signal having the black level is assigned to dot "$2_{15}$" indicated by ①, a non-inverted picture signal having the white level is assigned to dot "$1_1$" indicated by ②, an inverted picture signal having the white level is assigned to dot "$1_3$" indicated by ③, and an inverted picture signal having the black level is assigned to dot "$1_{11}$" indicated by ④. Here, the range of the voltage level of the picture signal F in FIG. 4 is defined as that of the picture signal F shown in FIG. 3.

Figure 5:
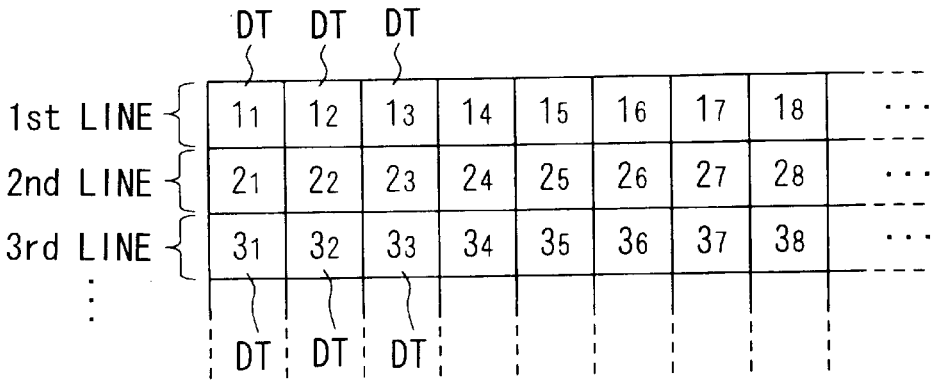
FIG. 5 shows the dot arrangement corresponding to the picture signal D (or W) of each line of the LCD 4 in FIG. 1.

In the first drive circuit M for the even-number dots, this picture signal F is amplified by the video amplifier 3, where the predetermined amplification degree is $\alpha$. FIG. 5 shows the dot arrangement corresponding to the picture signal D (or W) of each line of the LCD 4 (each dot is indicated by reference symbol DT). The amplified picture signal D is applied to the dot electrode (corresponding to the relevant liquid crystal element) of each odd-number dot of the first line, second line, third line, . . . by using a selector (not shown). Also in the second drive circuit M for the even-number dots, the picture signal H output from the polarity inversion circuit is amplified by the predetermined amplification degree $\alpha$, and the amplified picture signal W is applied to the dot electrode (corresponding to the relevant liquid crystal element) of each even-number dot of the first line, second line, third line, . . . by using a selector (not shown).

Figure 6A:
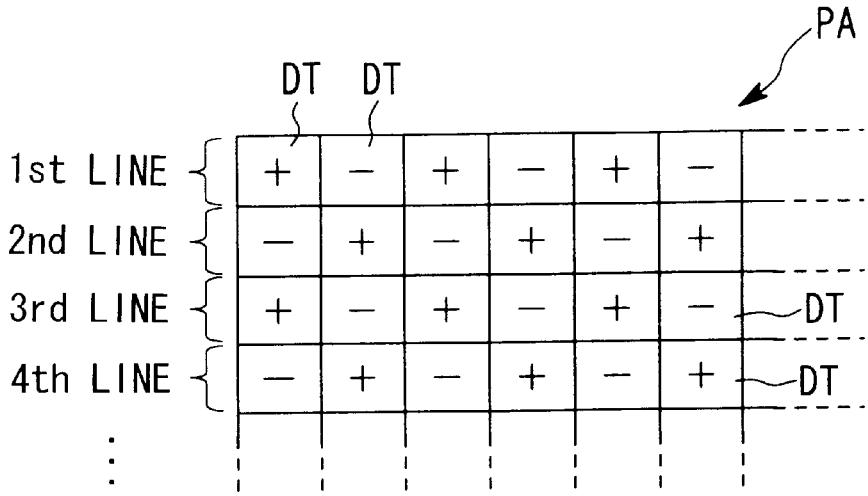
FIGS. 6A and 6B are diagrams showing the polarity of each dot when the lines of the display screen of LCD 4 are scanned.

Accordingly, the polarity of the picture signals D and W supplied to the liquid crystal elements of dots DT of each line (of the display screen of the LCD) has a pattern PA shown in FIG. 6A. That is, FIG. 6A is a diagram showing the polarity of each dot when the lines of the display screen of LCD 4 is scanned, where "+" indicates the polarity corresponding to the non-inverted signal, while "−" indicates the polarity corresponding to the inverted signal (this explanation is also applied to the following FIG. 6B). More specifically, the scanning of the display screen is repeatedly performed where the period of the repeated operation is from the starting time of the scanning of the first line of the display screen to the ending time of the scanning of the last line.

Figure 6B:
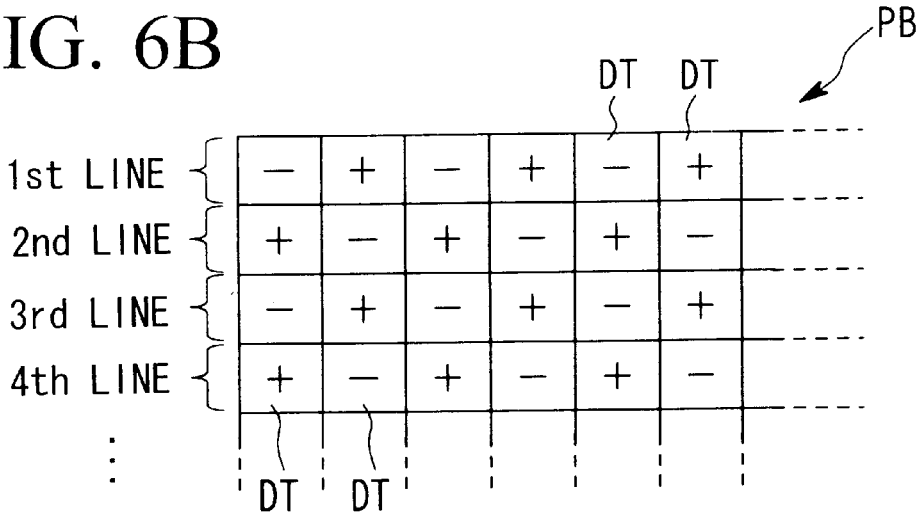

When the display screen is scanned immediately after the scanning according to the polarity pattern as shown in FIG. 6A, the polarity of the picture signals D and W supplied to the liquid crystal elements of dots of each line has a pattern PB shown in FIG. 6B by changing the signal level of the above-explained polarity inversion signal DINP as follows:

That is, in the scanning of line 1, the above polarity control circuit supplies a polarity inversion signal DINP having the "H" level to the polarity inversion circuit 2 of the first drive circuit M (relating to the output picture signal D), while the above polarity control circuit supplies a polarity inversion signal DINP having the "L" level to the polarity inversion circuit 2 of the second drive circuit M (relating to the output picture signal W). Accordingly, an-inverted signal is provided to dot "$1_1$", dot "$1_3$", . . . , dot "$1_{15}$" relating to the picture signal F, while a non-inverted signal is provided to dot "$1_2$", dot "$1_4$", . . . , dot "$1_{16}$" relating to the picture signal H.

In the scanning of the second line, the polarity control circuit supplies a polarity inversion signal DINP having the "L" level to the polarity inversion circuit 2 of the first drive circuit M, while the above polarity control circuit supplies a polarity inversion signal DINP having the "H" level to the polarity inversion circuit 2 of the second drive circuit M. Accordingly, an inverted signal is provided to dot "$2_1$", dot "$2_3$", . . . , dot "$2_{15}$" relating to the picture signal F, while a non-inverted signal is provided to dot "$2_2$", dot "$2_4$", . . . , dot "$2_{16}$" relating to the picture signal H.

Also for each of the following lines, an operation similar to that suitable for the line 1 or line 2 is performed. More specifically, an operation similar to that applied to the line 1 is performed to odd-number lines 3, 5, . . . , while an operation similar to that applied to the line 2 is performed to even-number lines 4, 6, . . . .

As a result, the alternating current like picture signals D and W are applied to the liquid crystal elements corresponding to each dot, so as to drive each liquid crystal element. Accordingly, an image is displayed on the display screen of the LCD 4.

Accordingly, in each drive timing of scanning the display screen, any adjacent dots (DT) both in the cross and longitudinal directions have the opposite polarities of the picture signal. That is, four dots adjacent to a dot having the polarity (+) in the cross and longitudinal directions have the opposite polarity (−), while four dots adjacent to a dot having the polarity (−) in the cross and longitudinal directions have the opposite polarity (+).

As explained above, in each drive operation for scanning the display screen, the polarity of each of the picture signal D or W is changed for each dot DT like an alternating current.

Also as explained above, the clip circuit 5 clips the amplitude range of the input picture signal G (or P) so as to correspond to the dynamic range of the video amplifier 3. Therefore, the amplitude range of the picture signal F (or H) input into the video amplifier 3 is controlled in a manner such that the amplitude range of the voltage of the signal does not exceed the dynamic range of the video amplifier 3. Accordingly, an erroneous operation of the video amplifier 3 can be prevented, and normal picture signal D (or W) can be continuously output, thereby showing images having high quality on the display screen of LCD 4.

Here, the amplitude range to be clipped by the clip circuit 5 may be determined in consideration of both the dynamic ranges of the polarity inversion circuit 2 and the video amplifier 3. Accordingly, the amplitude of the input picture signal E can be controlled corresponding to the dynamic range of the polarity inversion circuit 2. Therefore, no picture signal E exceeding the relevant dynamic range is input, thereby preventing an erroneous operation of the polarity inversion circuit 2. That is, it is possible to prevent any undesirable phenomenon such as outputting an abnormal signal by which the following polarity inversion circuit 2 and video amplifier 3 do not normally operate.

In addition, the clip circuit 5 may be arranged before the gamma correction circuit 1. In this case, the amplitude of the input picture signal E can be controlled according to the dynamic range of the gamma correction circuit 1. Therefore, no picture signal E having an amplitude exceeding the relevant dynamic range is input, thereby preventing an erroneous operation of the gamma correction circuit 1. That is, it is possible to prevent any undesirable phenomenon such as outputting an abnormal signal by which the following polarity inversion circuit 2 and video amplifier 3 do not normally operate.

Furthermore, the amplitude range to be clipped by the clip circuit 5 may correspond to all dynamic ranges of the gamma correction circuit 1, polarity inversion circuit 2, and the video amplifier 3.

An embodiment of the present invention has been explained in detail; however, possible embodiments are not limited to this embodiment and any design modification or variation within the scope and spirit of the present invention is possible.

Figure 7:
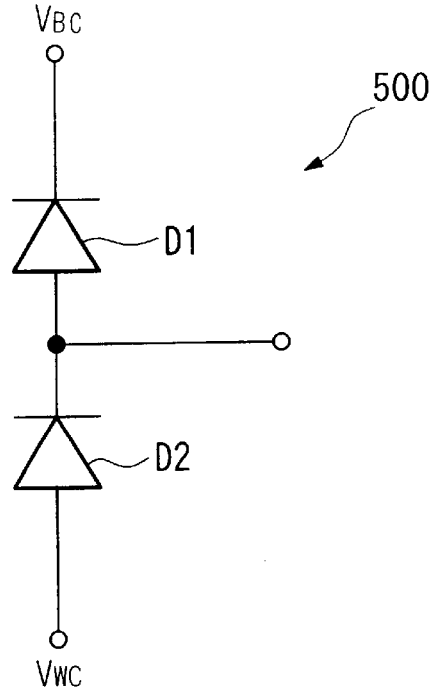
FIG. 7 is a block diagram showing the structure of clip circuit 500 used in the drive circuit M of the LCD, as the second embodiment according to the present invention.

For example, in the drive circuit M of the LCD as the second embodiment according to the present invention, clip circuit 500 as shown in FIG. 7 is used in place of the clip circuit 5 shown in FIG. 1. In the clip circuit 500, diodes are used as the elements used for the clipping operation.

That is, in FIG. 7, the clip circuit 500 consists of two serially connected diodes D1 and D2, where the contact between the anode of diode D1 and the cathode of diode D2 is connected to input terminal B of the polarity inversion circuit 2 in FIG. 1. Accordingly, the control voltage signal BC of voltage $V_{BC}$ is input into the cathode of diode D1, and the control voltage signal WC of voltage $V_{WC}$ is input into the anode of diode D2.

That is, as shown in the formulas in the brackets in FIG. 2, the upper limit voltage $V_U$ in the clipping operation of the clip circuit 500 is "voltage $V_{BC}$−voltage $V_B$", and the lower limit voltage $V_D$ in the clipping operation of the clip circuit 500 is "voltage $V_{WC}$+voltage $V_B$", where voltage $V_B$ is the value of the voltage drop in the forward direction of the diodes D1 and D2.

Accordingly, the amplitude of the picture signal E input from the gamma correction circuit 1 is clipped based on the upper limit voltage $V_U$ and the lower limit voltage $V_D$, which are determined according to the dynamic range of the video amplifier 3, so that the amplitude of the signal can be controlled to have a value suitable for the dynamic range of the video amplifier 3.

Additionally, similar to the clip circuit 5 in the first embodiment, the voltage $V_{BC}$ of the control voltage signal BC and the voltage $V_{WC}$ of the control voltage signal WC can be changed by a control voltage circuit (not shown). By using the control voltage circuit, the upper limit voltage $V_U$ and the lower limit voltage $V_D$ can be controlled according to the voltage level of the input picture signal E.

The basic operation of the second embodiment is the same as that of the first embodiment; thus, explanations thereof are omitted.

What is claimed is:

1. A drive circuit of an active-matrix type liquid crystal display (LCD), for supplying a picture signal, whose polarity is alternately changed like an alternating current, to each electrode of liquid crystal elements of the LCD, comprising:

a clip circuit for clipping the amplitude range of the voltage of the picture signal input from an input terminal;

a polarity inversion circuit for receiving the picture signal whose amplitude range was clipped by the clip circuit, and for converting the picture signal so that an inverted signal and a non-inverted signal are alternately assigned to each dot; and a video amplifier for amplifying the voltage level of the converted picture signal by a predetermined amplification degrees wherein the clip circuit comprises two serially connected diodes, and predetermined control voltages are respectively applied to the cathode of one of the two diodes and the anode of the other diode, and the contact between the two diodes is connected to an input terminal of the polarity inversion circuit.

2. A drive circuit as claimed in claim 1, wherein the clip circuit clips the amplitude range of the voltage of the picture signal in a manner such that the clipped amplitude range is suitable for the dynamic range of the video amplifier and the output voltage level from the video amplifier does not exceed the relevant dynamic range.

3. A drive circuit as claimed in claim 1, wherein the upper limit voltage and the lower limit voltage of the amplitude range in the clipping operation executed by the clip circuit are variable according to the voltage of a control signal supplied to the clip circuit.

4. A drive circuit of an active-matrix type liquid crystal display (LCD), for supplying a picture signal, whose polarity is alternately changed like an alternating current, to each electrode of liquid crystal elements of the LCD, comprising:

a clip circuit for clipping the amplitude range of the voltage of the picture signal input from an input terminal;

a polarity inversion circuit for receiving the picture signal whose amplitude range was clipped by the clip circuit, and for converting the picture signal so that an inverted signal and a non-inverted signal are alternately assigned to each dot;

a video amplifier for amplifying the voltage level of the converted picture signal by a predetermined amplification degree; and a gamma correction circuit for correcting the gradation characteristics of the picture signal, and wherein:

the clip circuit is connected to an input terminal of the gamma correction circuit and an output terminal of the gamma correction circuit is connected to an input terminal of the polarity inversion circuit.

5. A drive circuit as claimed in claim 4, wherein the clip circuit clips the amplitude range of the voltage of the picture signal in a manner such that the clipped amplitude range is suitable for the dynamic range of the gamma correction circuit and the output voltage level from the gamma correction circuit does not exceed the relevant dynamic range.

6. A drive circuit of an active-matrix type liquid crystal display (LCD), for supplying a picture signal, whose polarity is alternately changed like an alternating current, to each electrode of liquid crystal elements of the LCD, comprising:

a clip circuit for clipping the amplitude range of the voltage of the picture signal input from an input terminal;

a polarity inversion circuit for receiving the picture signal whose amplitude range was clipped by the clip circuit, and for converting the picture signal so that an inverted signal and a non-inverted signal are alternately assigned to each dot; and a video amplifier for amplifying the voltage level of the converted picture signal by a predetermined amplification degree, wherein the clip circuit clips the amplitude range of the voltage of the picture signal in a manner such that the clipped amplitude range is suitable for the dynamic range of the polarity inversion circuit and the output voltage level from the polarity inversion circuit does not exceed the relevant dynamic range.

7. A drive circuit as claimed in claim 6, wherein the upper limit voltage and the lower limit voltage of the amplitude range in the clipping operation executed by the clip circuit are variable according to the voltage of a control signal supplied to the clip circuit.

* * * * *